United States Patent [19]

Womble

[11] 4,394,810

[45] Jul. 26, 1983

[54] CHAIN LINK REPAIR DEVICE

[76] Inventor: Larry E. Womble, 1400 Hardisty Rd., Bedford, Tex. 76021

[21] Appl. No.: 207,210

[22] Filed: Nov. 17, 1980

[51] Int. Cl.[3] ..... B21L 21/00

[52] U.S. Cl. ..... 59/7

[58] Field of Search ..... 59/7, 11; 29/256, 265; 269/253; 254/100

[56] References Cited

U.S. PATENT DOCUMENTS

| | | | |
|---|---|---|---|
| 397,262 | 2/1887 | Williams | 140/93 A |
| 752,074 | 2/1904 | Jackson | 411/435 |
| 762,060 | 6/1904 | Huhn | 29/239 |
| 1,412,165 | 4/1922 | Cary | 254/234 |
| 1,710,092 | 4/1929 | Hitchcock | 59/7 |
| 1,817,628 | 8/1931 | Kessler | 24/71.1 |
| 1,994,270 | 3/1935 | Cetrano | 59/7 |
| 2,361,971 | 11/1944 | Shipman | 59/7 |
| 2,382,447 | 8/1945 | Schaeufele | 59/7 |
| 2,387,551 | 10/1945 | Abramson | 59/7 |
| 2,622,389 | 12/1952 | Sjostrom | 29/256 |
| 2,826,893 | 3/1958 | Falk | 59/7 |
| 2,950,899 | 8/1960 | Wilson | 254/234 |
| 2,990,738 | 4/1961 | Zysset | 269/253 |
| 3,108,783 | 10/1963 | Foust | 29/256 |
| 3,379,005 | 4/1968 | Jones | 59/7 |
| 3,648,973 | 3/1972 | Farrell | 254/231 |

FOREIGN PATENT DOCUMENTS

| | | | |
|---|---|---|---|
| 711431 | 6/1965 | Canada | 59/7 |
| 917700 | 9/1946 | France | 59/7 |

*Primary Examiner*—Gene Crosby

*Attorney, Agent, or Firm*—William L. Martin, Jr.

[57] ABSTRACT

The invention comprises a combination vise and breaker pin for facilitating repair of metal drive chains. The vise serves to pull the links of a chain together so that tension is maintained throughout the chain while links between vise jaws become loose and readily repairable. This feature is combined with a breaker pin moving within a hollow channel axial of a full thread hex head bolt. A breaker point having an annular shoulder is attached at one end of the breaker pin. The breaker pin is free to slide back and forth within the bolt except as limited by the annular shoulder. The breaker pin cooperates with a U-shaped cradle suitable for holding a link. The breaker point is brought into contact with the center bearing of a chain link when the left and right-hand jaws of the vise are moved toward one another. The bolt carrying the breaker pin is then tightened against the chain link bearing pin. If the chain link bearing pin is not dislodged, the workman may give the breaker pin a sharp rap with a hammer in order to dislodge the pin without damage to the bolt threads.

5 Claims, 3 Drawing Figures

CHAIN LINK REPAIR DEVICE

BACKGROUND OF THE INVENTION

1. Field of the Invention.

The present invention relates to means for repairing metallic drive chains, and more specifically the facilitation of the removal of individual links from such a chain while the chain remains upon the driven equipment. The invention also relates to an improved means for driving the center bearing out of a metallic drive chain link, including the provision of a drift in the form of a breaker pin slidably engaged in axial relationship with a threaded bolt.

2. Description of the Prior Art.

There have been many attempts to obtain a satisfactory metal drive chain repair tool. Various means have been suggested for tightening such chains. Patent Number 752,074 to Jackson in 1904 shows an implement designed to be employed in repairing the driving-chains of automobiles and bicycles and roller chains wherever employed without the necessity of removing the chain from the vehicle or machine. The Jackson tightener holds the chain taunt, so that the links between the engaging-jaws of the said tightener becomes slack and may be removed for the purpose of repairing or for the purpose of replacing them with new links.

In tighetners employing the Jackson concept, there are a pair of jaw-heads, each head having a pair of longitudinally disposed holes parallel to one another. A threaded rod rigidly secured within one of the holes of one of the heads passes loosely through the corresponding hole in the other head. Devices similar to the Jackson tightener include only one unthreaded rod secured within the remaining hole in one of the heads and passing loosely through the corresponding hole in the other head. The provision of only one unthreaded rod in such devices causes these devices to bind during the tigthening process. The tendency of such devices to bind has been a long standing problem in the art.

The applicant does not admit that the Jackson patent is prior art as to this invention. It is discussed for whatever relevance it may have. Other patents known to the applicant include the following:

1. U.S. Pat. No. 397,262, Williams, 1889;
2. U.S. Pat. No. 3,648,973, Farrell, 1972;
3. U.S. Pat. No. 3,108,783, Foust, 1960;
4. U.S. Pat. No. 1,817,628, Kessler, 1931;
5. U.S. Pat. No. 2,950,899, Wilson, 1960;
6. U.S. Pat. No. 1,412,165, Cary, 1922; and
7. U.S. Pat. No. 762,060, Huhn, 1904.

None of the previously cited references, nor any other references known to the applicant, provide applicant's means for removal of the center bearing pin in individual chain links. Where metal drive train applications involve massive machinery, repairs often a difficult matter. In the case of such heavy machinery as an oil well pump, for example, the chain drive has to be loosened, the track removed, and ex situ repair arranged. Often the center bearing pin in such large chain drive links presents a serious repair difficulty. Such bearings are often frozen within the chain link and great force is required to drive the bearing out. It is often difficult to remove this bearing without damage to the chain and without damage to impellor shaft of whatever threaded bearing puller or pusher device that is used. A need has long existed for a tool which facilitates the removal of the bearing without causing other damage.

Accordingly, it is an object of this invention to provide a chain link repair device able to tension a large metal drive chain without binding so that links within the device are loose enough to repair while links without the device are tight enough to maintain the chain upon the driven machinery.

Another object of the invention is to provide a breaker impact pin for use as a drift in cooperation with an axially channeled forcing bolt such that a sharp blow from a hammer may be applied at one end of the breaker pin without damage to the threads of the impellor bolt while transmitting the impact of the hammer directly to the center bearing pin of a chain link.

SUMMARY OF THE INVENTION

The invention comprises a combination vise and breaker pin for facilitating repair of metal drive chains. The vise serves to pull the links of a chain together so that tension is maintained throughout the chain while links between vise jaws become loose and readily repairable. This feature is combined with a breaker pin moving within a hollow channel axial of a full thread hex head bolt. A breaker point having an annular shoulder is attached at one end of the breaker pin. The breaker pin is free to slide back and forth within the bolt except as limited by the annular shoulder. The breaker pin cooperates with a U-shaped cradle suitable for holding a link. The breaker point is brought into contact with the center bearing of a chain link when the left and right-hand jaws of the vise are moved toward one another. The bolt carrying the breaker pin is then tightened against the chain link bearing pin. If the chain link bearing pin is not dislodged, the workmen may give the breaker pin a sharp rap wih a hammer in order to dislodge the pin without damage to the bolt threads.

DESCRIPTION OF THE PREFERRED EMBODIMENT

Referring now to the figures wherein numerals designate like parts, a preferred embodiment of the invention will be described in detail.

Figure 1:
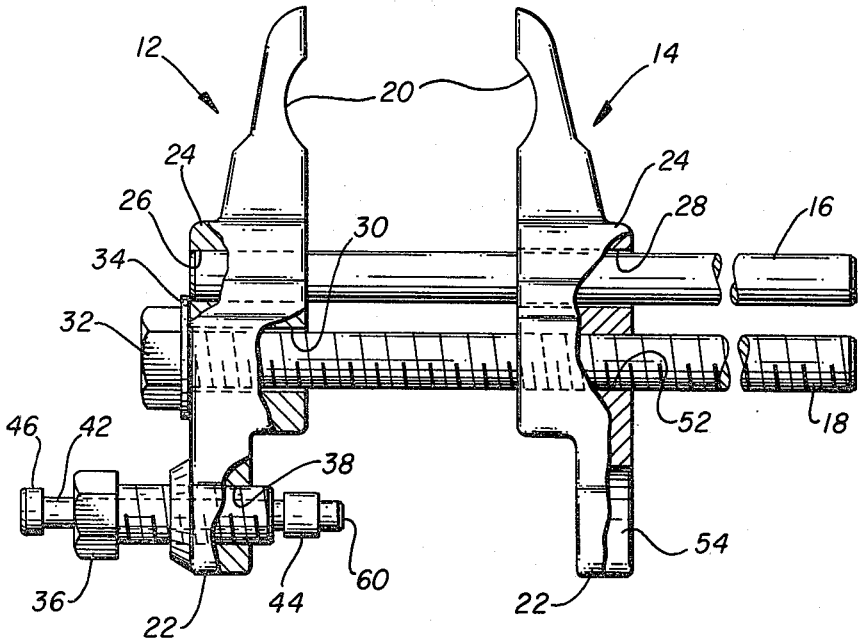
FIG. 1 is a side elevational view showing the chain link repair device embodying the present invention.

With reference to FIG. 1, one embodiment of a chain link repair device 10 is shown wherein oppositely disposed jaw-heads 12 and 14 are shown connected by guide rods 16 and actuator bolt 18. While the jaw-heads of FIG. 1 appear to have similar construction, there are important differences between the two jaw-heads. The left-hand jaw-head 12 is designed to remain in a fixed longitudinal relationship with guide rod 16 or with actuator screw 18. Righthand jaw-head 14 is designed to slide longitudinal of guide rods 16 while bound in a spiral threaded relationship with actuator screw 18.

Figure 2:
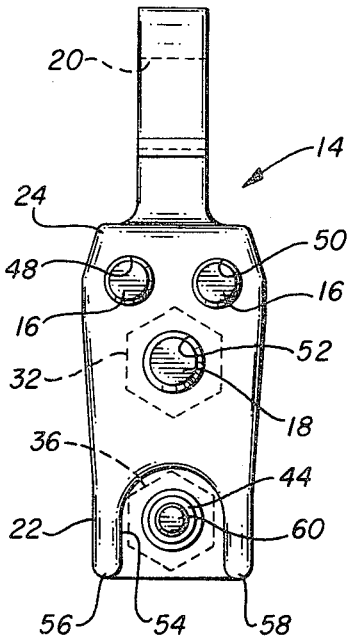
FIG. 2 is a cross-sectional view taken areas righthand jaw-head of FIG. 1.

Each jaw-head 12 and 14 has an upper engagement surface 20 and a downwardly extending flange 22. While upper engagement surfaces 20 are substantially mirror images of one another, downwardly extending flanges 22 are similar only in the side elevational view shown in FIG. 1. The front elevational view of right-hand jaw-head 14 set forth in FIG. 2 depicts the unique configuration of downwardly extending flange 22 of righthand jaw 14. This figure is discussed below.

Engagement faces 20 of jaw-heads 12 and 14 are concave. These concavities in engagement faces 20 are defined by the arc of the circle having a radius greater than or equal to the radius defining the outer cylindrical surface of the chain roller of the metallic drive chain being repaired. This definition of the concavity of engagement surface 20 is equally applicable to situations in which block chains are being repaired with the modification that half cylindrical surfaces are presented at each end of an individual chain block.

The width of jaw-heads 12 and 14 in the region of engagement surfaces 20 measured along the line parallel to the axes of the arc of said concave surfaces 20 is less than or equal to the length of the roller of the roller chain. The depth of the upper engaging portion of jaw-heads 12 and 14 measured along the line perpendicular to the concave engaging surfaces is less than or equal to the distance between any two rollers within one link of the metallic drive chain. Thus, the dimensions of the upper engaging portions of jaw-heads 12 and 14 are such as to allow the insertion of the upper engaging surfaces into the space in a metallic drive roller chain defined by the rollers and the links of such chains to be repaired.

The upper engaging surfaces of jaw-heads 12 and 14 are buttressed by additional metal and become thicker depthwise beginning generally at the bottom edge of engagement surface 20 and continuing in increasing thickness until shoulders 24 of jaw-heads 12 and 14 are reached. The purpose of the increase of thickness is to increase the strength of the upper engaging surfaces and to enable the surfaces to resist distortion during the process of tightening the metal roller drive chain.

Three holes are defined within each shoulder 24 of jaw-heads 12 and 14. A cylindrical channel 26 defines a hole for rigidly securing one end of guide rods 16 and lefthand jaw-head 12. Another such cylindrical channel is parallel to channel 26 although not shown in FIG. 1. This second channel will be designated by the number 28. The axis of channel 28 is parallel to the axis of channel 26 and both axes are in a plane perpendicular to the longest dimension line of jaw-head 12. One end of guide rod 16 is rigidly secured within each of channels 26 and 28 by means of welding or other suitable means.

Cylindrical channel 30 defines a hole axially perpendicular to the front face of lefthand jaw-head 12. Cylindrical channel 30 is of a dimension adequate to receive bolt 18 and allow the threads of such bolt to pass therethrough without hindrance. Bolt head 32 is held away from jaw-head 12 by means of washer 34.

Downwardly extending flange 22 of jaw-head 12 defines a cylindrical channel threaded to receive bearing push bolt 36. Bearing push bolt 36 cooperates with threaded channel 38 so that bearing bolt 36 may be screwed into and through threaded channel 38 axially of said channel along a line perpendicular to the front face of lefthand jaw-head 12.

Bearing push bolt 36 within itself defines an axially cylindrical channel 40. Channel 40 is of a dimension permitting the slidable insertion of breaker pin 42. Breaker pin 42 is of a length greater than the length of breaker push bolt 36. Annular breaker pin shoulder 44 is attached to one end of breaker pin 42 after its insertion through bearing push bolt 36. The other end of breaker pin 42 is provided with a fixed annular shoulder 46, as well.

Referring now to FIG. 2, a front elevational view of righthand jaw-head 14 will be seen. FIG. 2 is actually a cross-sectional view taken along line 2 of FIG. 1. FIG. 2 reveals that the upper engaging surface 20 of right-hand jaw-head 14 is of a thickness substantially less than the thickness of jaw-head 14 at shoulder portion 24. The shape of jaw-head 12 is identical in this respect. As has been previously explained, the dimension of the upper engaging surface of jaw-heads 12 and 14 is such as to allow the insertion into a metallic drive roller or block chain.

FIG. 2 is also an end view of channels 48 and 50 defining holes through which guide rods 16 may be slidably inserted. The axes of the cylinders defining holes 48 and 50 are colinear with the axes of cylinders defining holes 26 and 28 previously discussed with reference to lefthand jaw-head 12. In operation, guide rods 16 are allowed to slide freely in either direction longitundinal of the axes of cylindrical channels 48 and 50.

FIG. 2 is also an end view of threaded channel 52 of righthand jaw-head 14. Threaded channel 52 has an axis colinear with the axis of free channel 30 discussed with reference to lefthand jaw-head 12. In operation, actuator screw 18 may be threaded into threaded channel 52 so that actuator screw 18 may be advanced through threaded channel 52 as bolt head 32 is turned in a clockwise direction.

FIG. 2 is also an end view of U-shaped cradle 54 defined at the downwardly extending flange 22 of right-hand jaw 14. U-shaped cradle 54 is defined by cradle arms 56 and 58. The width of prongs 56 and 58 measured along lines perpendicular to the plane face illustrated in FIG. 2 is equivalent to the width previously defined for engagement services 20 measured along the line perpendicular to the plane of presentation of the device in FIG. 1. However, prongs 56 and 58 are of any dimension suitable for insertion into the space in a roller chain defined by the rollers and links therein. U-shaped cradle 54 defines an arc of a circle having a radius slightly greater than the outside cylindrical surface of the rollers of the roller chain. Prongs 56 and 58 extend parallel to one another at either end of the arc defined by U-shaped cradle 54.

Figure 3:
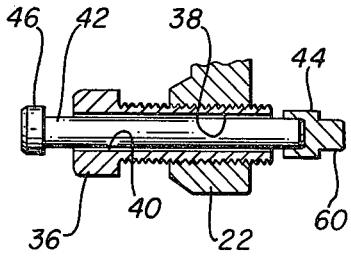
FIG. 3 is a cross-sectional view taken through the bearing push bolt of FIG. 1 showing the impellor bolt with its interiorly disposed breaker pin.

Referring now to FIG. 3, a cross-sectional view of bearing push bolt 36 and breaker pin 42 reveals the unique structure and arrangement of the means used in the present invention for driving out the pin from within the bushing of any of the several rollers within a metallic roller chain subject to repair. By reference to FIG. 3, it will be seen that bearing push bolt 36 has a smooth interior channel 40 along which slides breaker pin 42. The movement of breaker pin 42 within channel 40 is limited by annual shoulder 46 at one end of breaker pin 42. After breaker pin 42 has been inserted within channel 40 of bearing push bolt 36, breaker point 44 is secured to the emergent end of breaker pin 42. Breaker point 44 consists of an annular shoulder channeled to receive one end of breaker pin 42 and rigidly secure it therein. The annular shoulder of breaker point 44 also supports breaker head 60. Breaker head 60 is made of any hard and durable metal and is the portion of chain link repair device 10 which is brought in direct contact with the center pin of any of the rollers of the roller chain subject to repair.

In operation, a roller of the roller chain is nested within U-shaped cradle 54 of FIG. 2. Jaw-heads 12 and 14 are brought together so that they closely approach each side of the roller chain being repaired. Bearing push bolt 36 is then advanced through threaded channel 38 so that breaker head 60 is brought into contact with one of the pins in the roller chain. If the pin of the roller chain resists the force applied urging bearing push bolt 36 against the pin, breaker pin 42 is given a sharp rap by a hammer at annular shoulder 46. By this means, the hammer blow is transmitted axially of bearing push bolt 36 to breaker head 60 directly against the pin centered within the roller of the roller chain being repaired. It is likely that the pin will become dislodged by the application of this force. After the pin is out, the pin bushing and ultimately the roller itself may be removed for repair or replacement. After the repair is made, the impellor bolt may be useful for inserting a new pin and reconnecting the chain.

It should be apparent that an invention having significant advantages have been provided. The jaw-heads may be advanced toward and away from one another without risk of binding because of the provision of a plurality of guide rods. These guide bars function to maintain the pitch and positioning of the jaw-heads with respect to one another while the upper engaging surfaces are being used to tension the drive chains and are being advanced towards one another by rotation of actuator screw 18.

A particularly significant advantage is provided by the bearing push bolt and breaker pin combination working in cooperation with the U-shaped cradle all at the downward extending flange end of the chain repair device.

Although a preferred embodiment of the invention has been described in detail, it is to be understood that various changes and substitutions can be made without department from the spirit and scope of the invention as defined by the appended claims.

I claim:

1. A chain link repair device for the repair or replacement of roller members of a roller drive chain comprising:
(a) A pair of jaw-heads,
(b) An elongated frame for the jaw-heads formed by means of a plurality of guide rods and at least one actuator screw all of which connect the jaw-heads with one another,
(c) Means for securing the guide rods in rigid relationship with one of the jaw-heads while maintaining the other jaw-head in sliding relationship with the said plurality of guide rods,
(d) Means for forcing the said jaw-heads towards each other when the actuator screw is rotated in a clockwise direction,
(e) Engagement surfaces extending in a direction perpendicular to the guide rods and suitable for insertion between the links of a roller chain and engaging the rollers thereof,
(f) A flange extending out of each of the said jaw-heads in a direction perpendicular to the said guide rods,
(g) Impact Means provided on said flanges for transmitting a blow to drive a pin out of any of the rollers of the said roller chain.

2. The drive chain repair device of claim 1 in which the impact means for transmitting a blow to drive out the pin of a roller of the roller chain further comprises:
(a) A first flange extending from one of the jaw-heads,
(b) A second flange extending from the other of the two jaw-heads,
(c) A generally parallel relationship between the first and second flanges,
(d) Means provided on the first flange for advancing a threaded bolt through such flange towards the second flange,
(e) Means on the second flange for snug receipt of a roller from the said roller chain so that the pin of such roller is in axial colinear relationship with the axis of said bolt.

3. The drive chain repair device of claim 2 wherein the bolt further comprises:
(a) A cylindrical channel axial of said bolt,
(b) An elongated pin for insertion into said channel having a length somewhat greater than the axial length of said bolt,
(c) Means for retaining said elongated pin within said bolt,
and
(d) An impact point provided at the end of the elongated pin closest to said second flange.

4. A chain link repair device for the repair or replacement of roller members of a roller drive chain comprising:
(a) a pair of jaw-heads,
(b) means for forcing said jaw-heads towards each other,
(c) a first flange extending from one of the jaw-heads,
(d) a second flange extending from the other of the two jaw-heads,
(e) means provided on said first flange for advancing a threaded bolt through such flange towards the second flange,
(f) means on the second flange for snug receipt of a roller from the said roller chain so that the pin of such roller is in axial colinear relationship with the axis of said bolt,
(g) a cylindrical channel axial of said bolt,
(h) an elongated pin for insertion into said channel having a length somewhat greater than the axial length of said bolt,
(i) first and second ends on said pin,
(j) means for retaining said elongated pin within said bolt,
(k) an impact receiving sholder at said first end of said elongated pin, and
(l) an impact transmitting breaker head at said second end of said elongated pin so that a hammer blow is transmitted axially of said bolt to said breaker head against said roller pin when said impact receiving sholder is struck.

5. A chain link repair device for the repair or replacement of roller members of a roller drive chain comprising:
(a) first and a second flange,
(b) connection means for connecting said first and second flanges,
(c) engaging means on the second flange for receipt of a roller from said roller chain so that the pin of such roller has an end exposed to said first flange,
(d) advancing means on said first flange defining a channel in axial alignment with said roller pin exposed from said second flange for applying incremental force to such roller pin, and
(e) an elongated pin for insertion into said channel having a length somewhat greater than the axial length of said channel so that a blow delivered to one end of said elongated pin is communicated to the roller pin exposed from said second flange.

* * * * *